US009691568B2

(12) United States Patent
Martin

(10) Patent No.: US 9,691,568 B2
(45) Date of Patent: Jun. 27, 2017

(54) ELECTRICAL CIRCUIT BREAKER INCLUDING A TRIP BLOCK

(71) Applicant: Schneider Electric Industries SAS, Rueil Malmaison (FR)

(72) Inventor: Willy Martin, Vaulenaveys le Haut (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/933,401

(22) Filed: Nov. 5, 2015

(65) Prior Publication Data

US 2016/0141121 A1 May 19, 2016

(30) Foreign Application Priority Data

Nov. 19, 2014 (FR) ..... 14 61176

(51) Int. Cl.
*H01H 9/00* (2006.01)
*H01H 9/20* (2006.01)
(Continued)

(52) U.S. Cl.
CPC ..... *H01H 9/20* (2013.01); *H01H 9/22* (2013.01); *H01H 71/0228* (2013.01); *H01H 9/24* (2013.01); *H01H 71/123* (2013.01)

(58) Field of Classification Search
CPC ..... H01H 71/125; H01H 9/20; H01H 9/22; H01H 9/24; H01H 71/0228; H01H 71/123;
(Continued)

(56) References Cited

U.S. PATENT DOCUMENTS 5,877,691 A 3/1999 Suptitz et al.
8,476,992 B2 * 7/2013 Yang ..... H01H 9/20 335/167
(Continued)

FOREIGN PATENT DOCUMENTS

EP 0 843 332 A1 5/1998
FR 2 703 506 A1 10/1994
WO WO 03/043156 A1 5/2003

OTHER PUBLICATIONS

French Preliminary Search Report issued Aug. 10, 2015 in French Application 14 61176, filed on Nov. 19, 2014 (with English Translation of Categories of Cited Documents).

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

The electrical circuit breaker includes a circuit breaker block including at least an electrical conductor equipped with a first fixed pastille. The circuit breaker block also includes a bridge equipped with at least a second pastille, a unit for controlling the mobile bridge and an actuator of the control unit. This actuator is able to switch between an armed configuration in which it activates the control unit and a disarmed configuration in which it does not activate the control unit. The circuit breaker block also includes a first electrical coupling module. The electrical circuit breaker also includes a trip block including an electronic trip circuit and a second module for electrically coupling with the first coupling module of the circuit breaker block. This circuit breaker is provided with an actuator arming latch.

10 Claims, 3 Drawing Sheets

(51) Int. Cl.

| | |
|---|---|
| ***H01H 9/22*** | (2006.01) |
| ***H01H 71/02*** | (2006.01) |
| *H01H 9/24* | (2006.01) |
| *H01H 71/12* | (2006.01) |

(58) Field of Classification Search
CPC ..... H01H 71/12; H01H 47/22; H01H 45/02; H01F 7/00; H01F 7/08
USPC ..... 335/172
See application file for complete search history.

(56) References Cited

U.S. PATENT DOCUMENTS

| | | | | |
|---|---|---|---|---|
| 8,614,618 | B2 * | 12/2013 | Darr | H01H 9/10 337/143 |
| 8,766,749 | B2 * | 7/2014 | Ganley | H01H 71/125 335/172 |
| 8,836,453 | B2 * | 9/2014 | Yang | H01H 9/20 335/167 |
| 2004/0257741 | A1 | 12/2004 | Cuny et al. | |

* cited by examiner

ELECTRICAL CIRCUIT BREAKER INCLUDING A TRIP BLOCK

The present invention relates to an electrical circuit breaker including a trip block.

In the field of electrical circuit breakers, it is known practice, for example from EP-A-0 843 332, to provide two or more independent blocks in a circuit breaker. In this document an electrical circuit breaker is equipped with a circuit breaker block, which includes fixed and mobile lands and a unit for controlling the position of the mobile land, and a trip block. It is possible to use a circuit breaker with different types of trip block: for example a thermal, magnetic, differential or electronic trip block. An electronic trip block makes it possible to perform both the functions of the thermal trip block and those of the magnetic trip block by virtue of the electronic processing of the measurements carried out. Such an electronic trip block has a life span shorter than that of the circuit breaker block. It is therefore generally removable and is mounted in the circuit breaker only upon the installation thereof. The electrical circuit breaker can fulfil its protection function only if the trip block is correctly connected to the circuit breaker block. However, this approach does not prevent the closure of the circuit breaker block when the trip block is absent or is not correctly connected.

It is this drawback that the invention intends more particularly to remedy by proposing a safer electrical circuit breaker.

With this in mind, the invention relates to an electrical circuit breaker comprising a circuit breaker block, which includes at least one electrical conductor equipped with a first fixed land. The circuit breaker block also includes a bridge equipped with at least one second land, the bridge being mobile between a first position in which the second land is in contact with the first land and a second position in which the second land is separated from the first land. The circuit breaker block also includes a control unit for the mobile bridge and an actuator of the control unit. This actuator is able to switch between an armed configuration in which it activates the control unit and a disarmed configuration in which it does not activate the control unit. Furthermore, the circuit breaker block includes a first electrical coupling module. The electrical circuit breaker also comprises a trip block, said block including an electronic trigger circuit and a second electrical coupling module coupled with the first coupling module of the circuit breaker block. In accordance with the invention, the trip block is provided with a lock for arming the actuator. Furthermore, this lock is elastically loaded to a first position in which the actuator is in the disarmed configuration and is adapted to be pushed back to a second position in which the actuator is in the armed configuration when the first and the second coupling modules are electrically connected.

By virtue of the invention, a reliable and simple mechanical system is developed to guarantee the protection of goods and people. The resulting mechanical system is simple, since the element implementing the invention, that is to say the lock as such, is very well known, easy to use and inexpensive. This system is also reliable, since the control of closure of the lands occurs only if the two control mechanisms, that is to say the lock and the actuator, are at the same time in the armed configuration for the actuator and the arming position for the lock. The closure of the circuit breaker block without analysis by the trip block is thus prevented.

According to aspects of the invention that are advantageous but not mandatory, such an electrical circuit breaker comprises one or more of the following features, taken in any technically acceptable combination:

- The arming lock pivots between its first position and its second position about a rotation axis parallel to a trajectory of connection of the first and second coupling modules.
- The arming lock is translationally mobile between its first position and its second position.
- The trip block is provided with a recess for receiving the actuator, the recess receiving the actuator when the arming lock is in its first position.
- The arming lock blocks the receiving recess when it is in its second position and prevents the actuator from being housed therein.
- The arming lock is provided with a tab, the tab being on the trajectory of connection when the lock is in its first position.
- The tab bears against an abutment of the trip block when the lock is in its arming position.
- Upon the electrical connection between the first and second coupling modules, the lock is displaced manually to its second position.
- The trip block is provided with a torsion spring for elastically loading the arming lock.
- The coupling module of the circuit breaker block is borne in a movable manner by the circuit breaker block.

The invention will be better understood and other advantages thereof will become more clearly apparent in light of the following description, given purely as a nonlimiting example and with reference to the attached drawings, in which.

Figure 1:
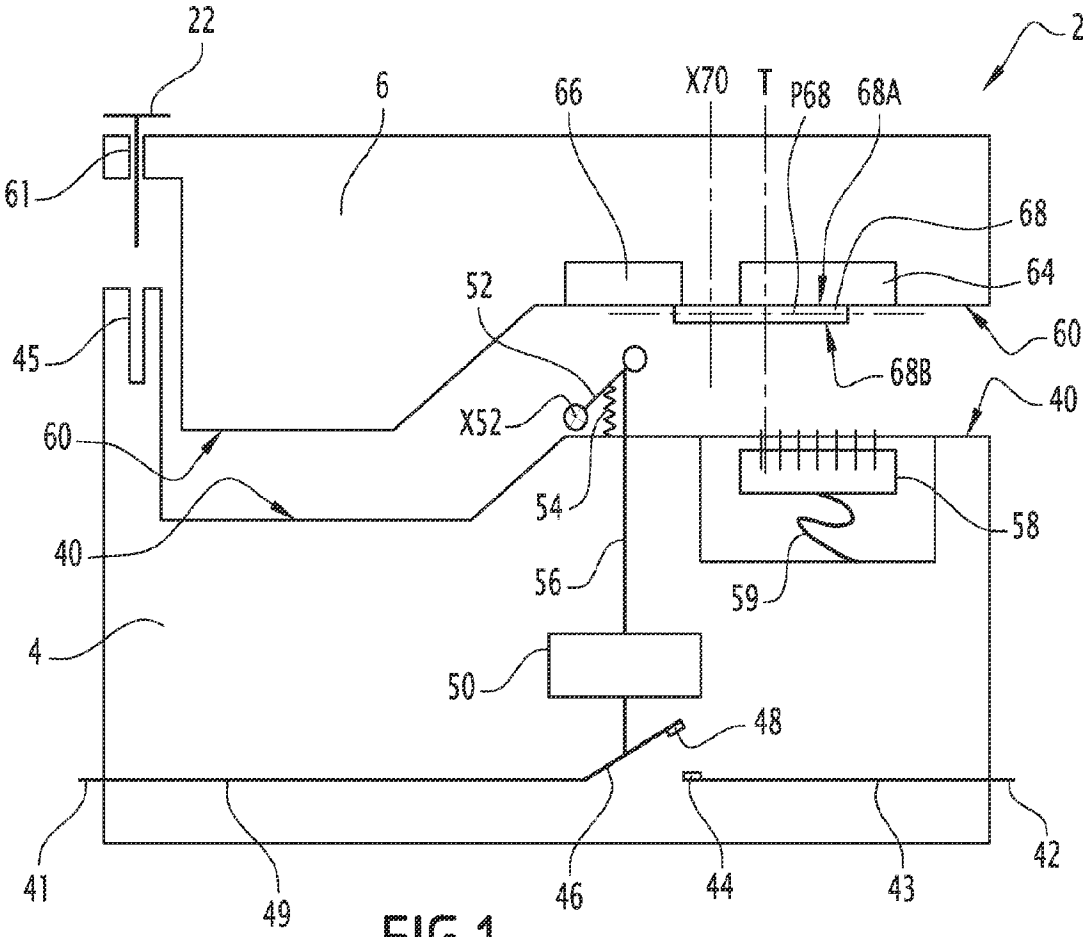
FIG. 1 is a schematic representation of an electrical circuit breaker according to the invention, with a trip block that is separated from a circuit breaker block.

In FIGS. 1 to 5, an electrical circuit breaker 2 is represented comprising a circuit breaker block 4 and a trip block 6.

The circuit breaker block 4 comprises a surface 40, an incoming current lug 41 and an outgoing current lug 42. The circuit breaker block 4 also comprises a fixed land 44 connected electrically with the outgoing current lug 42 via an electrical conductor 43. The circuit breaker block 4 also comprises a bridge 46 equipped with a second land 48. The bridge 46 is mobile between a first position in which the second land 48 is in contact with the first land 44 and a second position in which the second land 48 is separated from the first land 44. The second land 48 is connected electrically with the incoming current lug 41 via an electrical conductor 49.

The circuit breaker block 4 also comprises a control unit 50, which is configured to control the displacement of the bridge 46. In particular, the control unit 50 is suitable for displacing the bridge 46 from its first position to its second position and vice versa.

Figure 3:
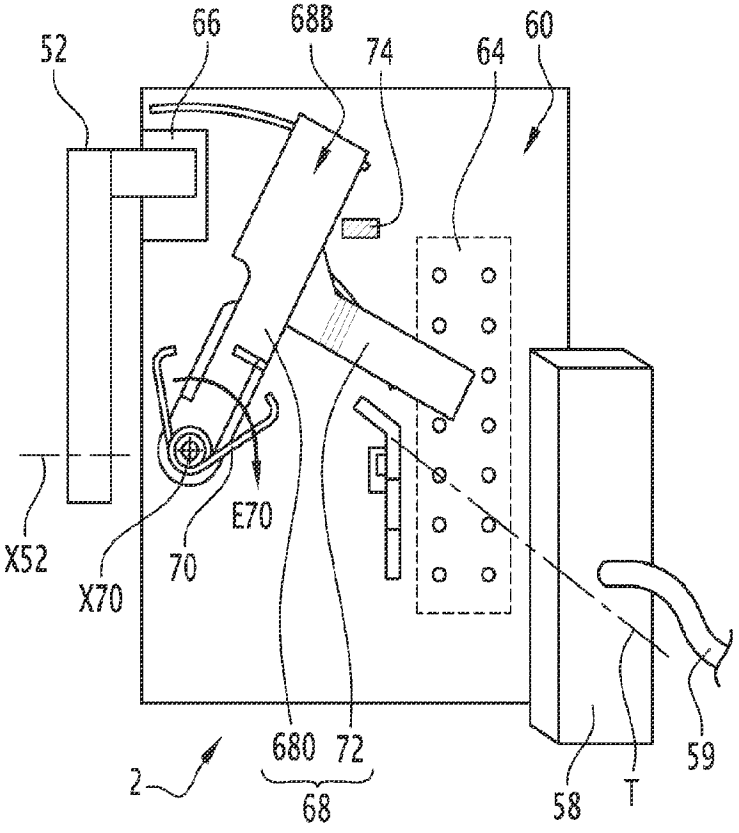
FIG. 3 is a diagram combining a partial view in elevation of the trip block, according to the arrow III in FIG. 2, and a perspective view of a coupling module of the circuit breaker block.
Figure 2:
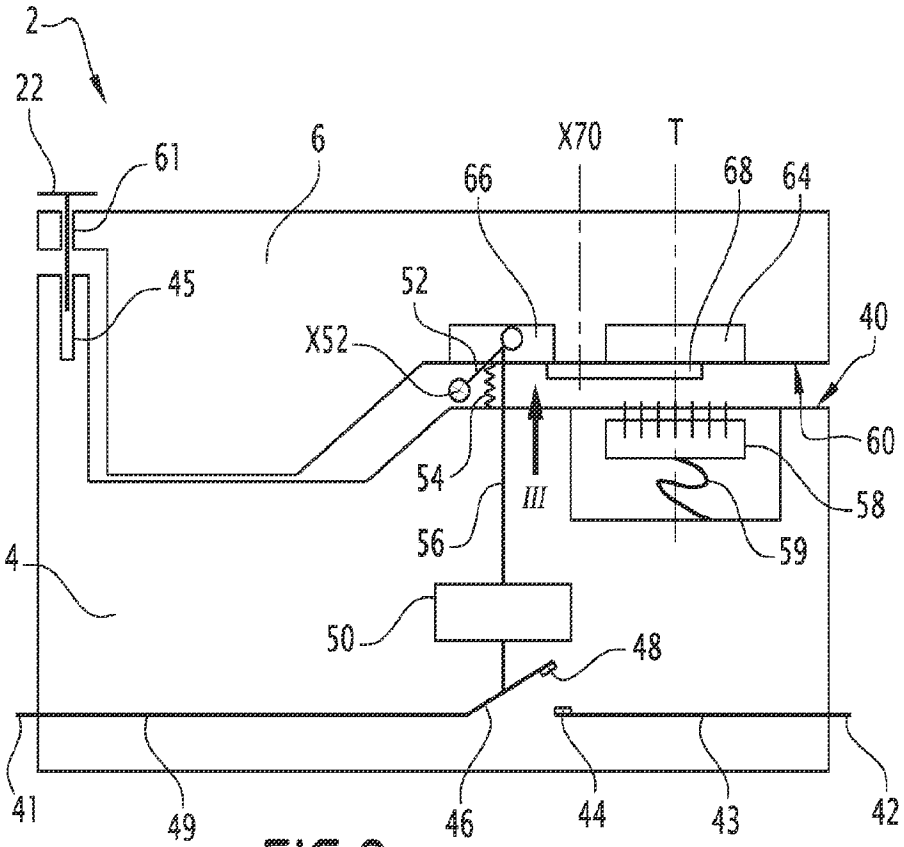
FIG. 2 is a schematic representation of the circuit breaker of FIG. 1, the trip block being mounted on the circuit breaker block but not being connected thereto.
Figure 5:
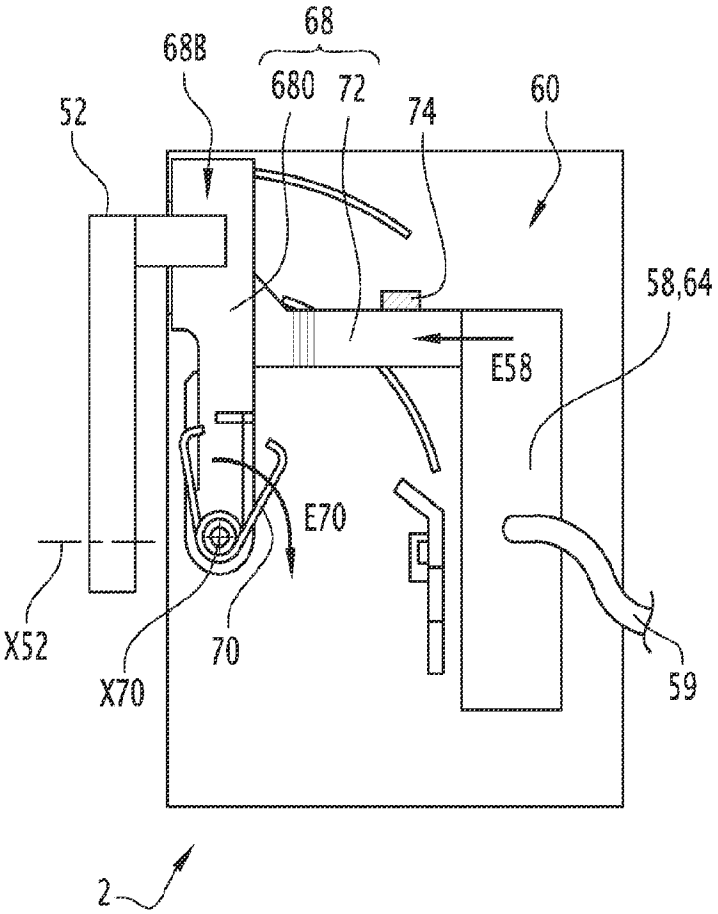
FIG. 5 is a partial view in elevation according to the arrow V in FIG. 4.
Figure 4:
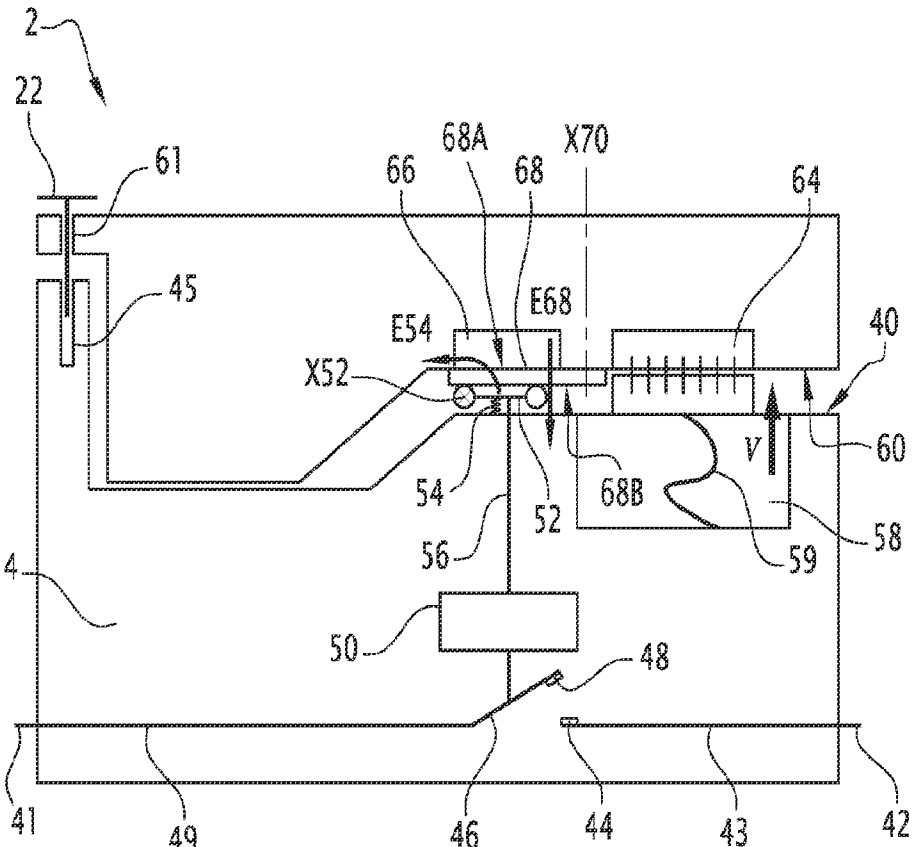
FIG. 4 is a schematic representation of the circuit breaker of FIG. 1 in which the trip block is mounted and connected with respect to the circuit breaker block.

Connection means 56 produce a mechanical link between an actuator 52 and the control unit 50. In the example considered here, the actuator 52 is an actuation lever. X52 is used to denote an axis at right angles to the plane of FIG. 1. The actuation lever 52 is rotationally mobile about the axis X52 and is suitable for switching between a so-called armed configuration, which is shown in FIGS. 4 and 5, in which the lever 52 mechanically activates the control unit 50 and a so-called disarmed configuration, which is shown in FIGS. 2 and 3, in which the lever 52 does not activate the control unit 50. A spring 54, notably a compression spring, secured to the surface 40 of the circuit breaker block 4, mechanically loads the lever 52 to its disarmed configuration. The spring 54 thus exerts a load E54 which tends to displace the lever 52 to its disarmed configuration.

The circuit breaker block 4 is also equipped with an electrical coupling module 58, said module 58 being connected to the block 4 via a flexible electrical conductor 59. In other words, the conductor 59 makes it possible to electrically link the module 58 to the circuit breaker block 4, while retaining a mobility of the module 58 in relation thereto.

The circuit breaker block 4 finally comprises, on its surface 40, a tapped bore 45.

The trip block 6 is provided with a surface 60 and a smooth bore 61 formed on its surface 60.

The trip block 6 is equipped with an electronic trigger circuit, said circuit being omitted from FIGS. 1 to 5 for improved clarity of the drawings. As is known per se, the function of the electronic trigger circuit is to measure the electrical current which passes between the incoming 41 and outgoing 42 lugs of the circuit breaker 2 and compare it to a defined value. The circuit is configured to control the opening or non-opening of the lands 44 and 48 as a function of the result of the abovementioned comparison.

The trip block 6 is also equipped with an electrical coupling module 64, this module 64 being in electrical connection with the trigger circuit. Furthermore, the module 64 is intended to be electrically connected to the coupling module 58 of the circuit breaker block 4. T is used to denote a trajectory of connection of the coupling modules 58 and 64.

The trip block 6 is also equipped with a recess 66 formed on the surface 60 of the block 6.

An arming lock 68 is mounted on the surface 60 of the trip block 6. 680 is used to denote a body of the lock 68 delimited between two surfaces 68A and 68B at right angles to the trajectory T. P68 is used to denote a plane at right angles to the trajectory T and passing through the middle of the body 680. The body 680 of the lock 68 has a globally rectangular section in the plane P68. The arming lock 68 is provided with a tab 72 protruding at right angles to the body 680 and parallel to the plane P68.

At one end of the body 680, the lock 68 is secured to a spring 70, such as a torsion spring, which is itself secured to the surface 60 of the trip block 6. X70 is used to denote a torsion axis of the spring 70. The axis X70 is at right angles to the plane P68 of the body 680 of the lock 68. The arming lock 68 pivots about the axis X70 between a first position, which is shown in FIGS. 2 and 3 and in which the actuation lever 52 is in the disarmed configuration, and a second position, which is shown in FIGS. 4 and 5 and in which the lever 52 is in the armed configuration. The first position is called lever 52 disarming position: in this position of the lock 68, the tab 72 is arranged on the trajectory T. The second position is called lever 52 arming position: the tab is outside of the trajectory T. The torsion spring 70 elastically loads the arming lock 68 towards its first position. The torsion spring 70 thus exerts a load E70 which tends to push the lock 68 towards its disarming position and, thereby, to place the tab 72 on the connection trajectory T.

For safety, an abutment 74 is formed on the surface 60 of the trip block 6, protruding at right angles to this surface. When the lock 68 is in its second position, the tab 72 bears on the abutment 74. In other words, the abutment 74 is configured to stop the lock 68 in its rotational travel and avoid, for example, damaging the spring 70.

The trip block 6 is configured to be mounted on the circuit breaker block 4, such that the surface 60 of the trip block 6 bears against the surface 40 of the circuit breaker block 4. Furthermore, in the mounted configuration, the tapped bore 45 of the circuit breaker block 4 is aligned with the smooth bore 61 of the trip block 6. A screw 22 is then provided to block the assembly between the block 4 and the block 6.

In the mounted configuration as shown in FIG. 2, the actuation lever 52 is in its disarmed position and is housed in the recess 66 of the trip block 6. The coupling module 58 of the circuit breaker block 4 is not connected electrically to the coupling module 64 of the trip block 6. Furthermore, the torsion spring 70 holds the arming lock 68 in its disarming position. Since the lock 68 is in its disarming position, the tab 72 is on the trajectory of connection T of the coupling modules 58 and 64. Consequently, the tab 72 of the lock 68 prevents the electrical connection between the coupling modules 58 and 64.

Since the actuation lever 52 is in its disarmed position, the control unit 50 keeps the bridge 46 in its second position in which the mobile land 48 is separated from the fixed land 44. No current can therefore pass between the incoming current lug 41 and the outgoing current lug 42. The electrical circuit breaker 2 is thus in its open configuration.

In order to switch from the open configuration of the electrical circuit breaker 2 to its closed configuration, the operator must manually displace the lock 68 to its second position, by pressing on the tab 72, and connect the coupling module 58 of the circuit breaker block 4 to the coupling module 64 of the trip block 6. Via the flexible conductor 59, the module 58 can be displaced in relation to the circuit breaker block 4 and can thus be connected to the module 64. The tab 72, which is driven by the operator until it bears against the abutment 74, drives the rest of the lock 68 which pivots about the axis X70. Once coupled to the module 64, the module 58 opposes the load E70 of the spring 70 with a load E58, which keeps the lock 68 in its arming position. In its arming position, the body 680 of the arming lock 68 blocks the recess 66 of the trip block 6, so that the actuation lever 52 is pushed by the surface 68B of the body 680 towards its armed position. The body 680 of the lock 68 opposes the load E54 of the spring 54 with a load E68 and keeps the lever 52 in its armed position.

The actuation lever 52 in its armed position mechanically acts on the control unit 50 via the connection means 56. The control unit 50 can then displace the bridge 46 towards its first position in which the mobile land 48 is in contact with the fixed land 44. An electrical current can therefore pass between the incoming current lug 41 and the outgoing current lug 42. The electrical circuit breaker 2 is thus in its closed configuration.

In the case where a malfunction occurs on the connection between the circuit breaker block 4 and the trip block 6, the circuit breaker 2 is configured to displace the bridge 46 towards its second position in which the lands 44 and 48 are separated. Thus, the circuit breaker interrupts any passage of current between the lugs 41 and 42. In particular, when an unforeseen disconnection occurs on the coupling modules 58 and 64, the lock 68 is displaced towards its first position and the lever 52 switches to the disarmed position and acts mechanically on the control unit 50 so that it immediately displaces the bridge 46 by cutting the passage of current between the lugs 41 and 42.

Also, in the case where the user forgets to connect the modules 58 and 64, the circuit breaker 2 is in its open configuration, the control unit 50 keeping the bridge 46 in its second position.

Finally, the function of the trip block 6 is also ensured in the case of breakage of a part of the lock 68. Both in the case of a breakage of the tab 72 and in the case of a breakage of the body 680, the connection of the modules 58 and 64 does not cause the displacement of the lever 52 towards its armed position by the surface 68B of the lock 68. The control unit 50 therefore keeps the circuit breaker 2 in its open configuration.

Various arrangements and variants of the electrical circuit breaker 2 can moreover be envisaged. By way of examples:

other embodiments are possible for the actuation lever 52, as actuators of the control unit 50;

the spring 70 is a traction or compression spring;

the spring 54 is a traction spring;

according to a variant not represented in the figures, the arming lock 68 is translationally mobile between its first position and its second position.

The embodiment and the variants envisaged above can be combined with each other to generate new embodiments.

The invention claimed is:

1. An electrical circuit breaker, comprising:

a circuit breaker block including:

at least one electrical conductor equipped with a first fixed land, a bridge equipped with at least one second land and mobile between a first position in which the second land is in contact with the first land and a second position in which the second land is separated from the first land, a control unit for the mobile bridge, an actuator of the control unit, this actuator being able to switch between an armed configuration in which it activates the control unit and a disarmed configuration in which it does not activate the control unit, and a first electrical coupling module; and a trip block including:

an electronic trigger circuit, a second electrical coupling module coupled with the first coupling module of the circuit breaker block, wherein the trip block is provided with an arming lock to arm the actuator, said arming lock being:

elastically loaded to a first position between the first electrical coupling module and the second electrical coupling module in which the actuator is in the disarmed configuration, and adapted to be pushed back to a second position in which the arming lock switches the actuator to the armed configuration when the first and the second coupling modules are electrically connected.

2. The circuit breaker according to claim 1, wherein the arming lock pivots between the first position and the second position about a rotation axis parallel to a trajectory of connection between the first and second coupling modules.

3. The circuit breaker according to claim 1, wherein the arming lock is translationally mobile between the first position and the second position.

4. The circuit breaker according to claim 1, wherein the trip block is provided with a recess to receive the actuator and in that the recess receives the actuator when the arming lock is in the first position.

5. The circuit breaker according to claim 4, wherein the arming lock blocks the receiving recess when the arming block is in the second position and prevents the actuator from being housed therein.

6. The circuit breaker according to claim 4, wherein the arming lock is provided with a tab, the tab being on a trajectory of connection between the first and second coupling modules when the arming lock is in the first position.

7. The circuit breaker according to claim 6, wherein the tab bears against an abutment of the trip block when the lock is in the second position.

8. The circuit breaker according to claim 1, wherein, for the electrical connection between the first and second coupling modules, the arming lock is displaced manually to the second position.

9. The circuit breaker according to claim 1, wherein the trip block is provided with a spring that elastically loads the arming lock.

10. The circuit breaker according to claim 1, wherein the coupling module of the circuit breaker block is borne in a movable manner by the circuit breaker block.

* * * * *